United States Patent [19]

Garraffa

[11] Patent Number: 4,796,618

[45] Date of Patent: Jan. 10, 1989

[54] BREATHING REGULATOR APPARATUS

[75] Inventor: Dean R. Garraffa, Garden Grove, Calif.

[73] Assignee: Undersea Industries, Inc., Rancho Dominguez, Calif.

[21] Appl. No.: 820,845

[22] Filed: Jan. 21, 1986

[51] Int. Cl.[4] ..... A62B 7/04

[52] U.S. Cl. ..... 128/204.26; 137/494; 137/908; 128/204.25

[58] Field of Search ..... 128/201.27, 204.25, 128/204.26, 205.24, 204.28; 137/494, 498, 505.27, 505.29, 484, 568, 908, 909

[56] References Cited

U.S. PATENT DOCUMENTS

| | | | |
|---|---|---|---|
| 2,728,340 | 12/1955 | Meidenbauer, Jr. | 128/204.26 |
| 4,016,746 | 3/1977 | Pedersen | 128/204.26 |
| 4,041,977 | 8/1977 | Matsuno | 128/204.26 |
| 4,076,041 | 2/1978 | Christianson | 128/204.26 |
| 4,140,113 | 2/1979 | Pedersen | 128/204.26 |
| 4,147,146 | 4/1979 | Christianson | 128/204.26 |
| 4,214,580 | 7/1980 | Pedersen | 128/204.26 |
| 4,446,889 | 5/1984 | Pedersen | 128/204.26 |
| 4,616,645 | 10/1986 | Pedersen et al. | 128/204.26 |

FOREIGN PATENT DOCUMENTS

| | | | |
|---|---|---|---|
| 6403328 | 9/1964 | Netherlands | 128/204.26 |
| 83/01576 | 5/1983 | PCT Int'l Appl. | 128/204.26 |

*Primary Examiner*—Edward M. Coven
*Assistant Examiner*—K. M. Reichle
*Attorney, Agent, or Firm*—Leonard Tachner

[57] ABSTRACT

A breathing regulator especially suited for use in scuba diving comprises an externally adjustable flow vane or deflector to redirect a portion of inlet high velocity air towards the diaphragm of a venturi initiated vacuum assist-type regulator configuration. The flow vane interrupts and redirects a selected portion of the air stream thereby balancing the low pressure area adjacent the diaphragm at a constant level throughout the breathing cycle. As a result, the diver can adjust his inhalation effort requirements to be constant throughout the breathing cycle.

6 Claims, 5 Drawing Sheets

BREATHING REGULATOR APPARATUS

BACKGROUND OF THE INVENTION

1. Field of the Invention

The present invention relates generally to pressure regulation and self-contained breathing systems such as those used in scuba diving equipment and more specifically, to a new improved means for altering the breathing characteristics of a demand-type regulator by permitting the user to selectively adjust the venturi action in the regulator to best suit his needs during diving.

2. Prior Art

Pressure regulators such as those employed in underwater breathing apparatus, utilize the pressure differential on opposite sides of a flexible diaphragm to operate an air valve which supplies air to a breathing chamber from which the diver breathes. Typically, such a flexible diaphragm is mounted to cover an opening in the wall of the breathing chamber whereby expansion of the diaphragm actuates the air valve. More specifically, when the diver inhales while the air inlet valve is closed, the pressure in the breathing chamber is reduced causing the diaphragm to bow inwards inside the breathing chamber and thereby allowing an air inlet valve to open. When the diver exhales, pressure in the chamber increases causing the diaphragm to move out to its original condition thereby closing the air inlet valve.

Recent prior art includes disclosure of various pressure regulator structures which provide a reduction in the effort required by the diver to breath from such regulators. More specifically, regulators have been designed so that a portion of the inlet air travels into the breathing mouthpiece area in the form of a stream of air which produces a venturi effect. This venturi effect further reduces the pressures in the breathing chamber so that in effect the diver is not necessarily doing all the work required to sufficiently reduce the breathing chamber pressure to pull in and retain the diaphragm and cracking effort force setting whereby to open the air inlet valve. Thus, the venturi effect makes it easier for the diver to inhale air from the regulator. Breathing regulators which employ such venturi-type action to assist in responding to the breathing demand of the diver are highly advantageous. Unfortunately, they are not always optimally configured for the breathing requirements for each diver or for particular diving depths where ambient pressure increases as a function of depth thereby changing the parameters for the diver's degree of breathing difficulty and breathing requirements.

In response to this disadvantage of an otherwise advantageous concept, prior art patents have addressed various ways of altering venturi action in the regulator automatically during the breathing cycle. Thus, for example U.S. Pat. No. 4,214,580 to Pedersen discloses a breathing apparatus of the venturi action regulator-type hereinabove discussed which utilizes an additional moving baffle to alter the venturi effect after the diver initially inhales. However, such modification to the venturi action is accomplished automatically and internally within the regulator without any control by the diver. Thus, despite the variation in venturi action, a diver using the device disclosed in this patent would still have no manually accessible control over the venturi action during the dive.

Another prior art patent which addresses the manual control aspect of venturi-type demand regulators is disclosed in U.S. Pat. No. 4,147,176 to Christianson. This patent discloses the concept of using a conical platform in conjunction with a diaphragm wherein the diaphragm gradually flattens down against the platform to reduce the effect of sensing area during the breathing cycle. One embodiment is disclosed which has an adjustable aspirator which permits the diver to externally change the aspiration effect during the dive. Unfortunately, there is an inherent disadvantage in the manner in which the diaphragm and conical platform interact to control the venturi assist during the breathing cycle which makes the performance of the regulator substantially non-uniform during the breathing cycle. As a result, the diver may adjust the regulator characteristics to provide him with an advantageous operation for one aspect of the breathing cycle only to find that during another portion of the breathing cycle the adjustment is unsuitable.

There is, therefore, a need to provide a regulator which is of the breathing demand-type, which utilizes venturi assist to control the degree of air inlet opening, which provides the user with an external adjustment for varying the venturi effect during the dive and which, most importantly, provides either a constant or a smooth changing level of performance during the entire breathing cycle for a given adjustment setting which can still be readily varied by the diver during the dive.

SUMMARY OF THE INVENTION

The present invention comprises an inhalation demand breathing regulator which solves the aforementioned need. More specifically, the present invention comprises a breathing regulator in which an externally adjustable flow deflector or flow vane is utilized to create a disturbance or diversion of high velocity air directed at the mouthpiece area of the regulator housing whether to provide an adjustable means for balancing the vacuum assist in demand regulators. The deflecting flow vane interrupts a selectible portion of the air stream and redirects it back into the housing, thus balancing the low pressure area behind the diaphragm which prevents a free flow condition and allows the demand regulator to be less sensitive to ambient water conditions. The vane can be readily varied by the diver external of the regulator case from one extreme in which the air stream is virtually free flowing into the mouthpiece to another extreme in which all or virtually all of the air stream is interrupted and deflected towards the diaphragm to substantially defeat the assist effect of the venturi action. Once the diver selects a particular vane position, the action of the vane on the air stream remains constant throughout the entire breathing cycle. Unlike the prior art, the present invention does not depend upon the relative position of a diaphragm and for example, a conical platform which relationship varies non-linearly during a breathing cycle. The effect of the present invention is a venturi assisted demand regulator which is less complex in structure, more reliable and more predictable in performance and which has an assist level which either remains constant or varies linearly throughout the breathing cycle for a selected setting of the vane position relative to the air flow.

OBJECTS OF THE INVENTION

It is therefore a principal object of the present invention to provide an improved venturi assisted demand-type breathing regulator primarily for use in diving and which entirely overcomes or at least substantially reduces the deficiencies of the prior art.

It is an additional object of the present invention to provide a venturi assisted demand-type breathing regulator primarily for use by scuba divers wherein the extent to which the venturi action affects the air flow may be readily varied by the diver during the dive and wherein the selected venturi effect can be adjusted to remain constant during the entire breathing cycle until further adjustment by the diver.

It is still an additional object of the present invention to provide a venturi assisted demand breathing regulator utilizing a rotatable deflector vane which, depending upon the position of the vein selected by the diver, deflects a portion of the air stream back into the housing thus balancing the low pressure area behind the diaphragm thereby allowing the demand regulator to be less sensitive to ambient water conditions.

It is still an additional object of the present invention to provide an externally adjustable venturi assisted demand breathing regulator particularly advantageous for scuba diving wherein the diver can adjust a device for interfering with the air stream emanating from the inlet valve into the housing whereby the degree to which the venturi effect aids the diver's breathing may be selectively fixed and held constant for the entire breathing cycle.

BRIEF DESCRIPTION OF THE DRAWINGS

The aforementioned objects and advantages of the present invention as well as additional objects and advantages thereof will be more fully understood hereinafter as a result of a detailed description of a preferred embodiment of the invention when taken in conjunction with the following drawings in which.

DESCRIPTION OF A PREFERRED EMBODIMENT

Figure 1:
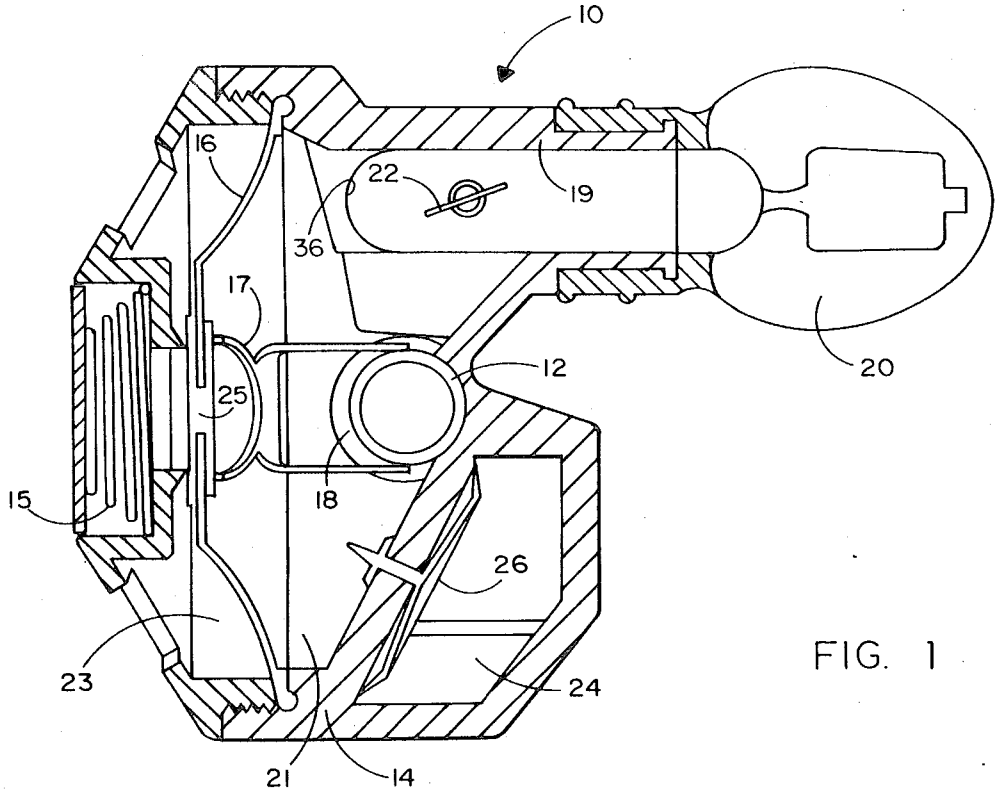
FIG. 1 is a cross-sectional view of the breathing regulator of the present invention.

Referring first to FIG. 1 it will be seen that the improved breathing regulator apparatus 10 of the present invention comprises a housing 14 having an air inlet tube 12 which will be connected to a suitable source of pressurized air supply in a well-known manner. Apparatus 10 also comprises a diaphragm 16 cooperating with a spring 15 and a lever 17 to selectively actuate an air inlet valve 18 in response to the breather's inhalation requirements as will be hereinafter more fully described. Apparatus 10 also provides a mouthpiece tube 19 connected to a mouthpiece 20 which is normally retained within the mouth of the user. As used herein, the term "mouthpiece tube" refers to the oval-shaped outline identified by reference numeral 36 in the Figures and the immediately adjacent structure. Apparatus 10 also provides a novel flow vane 22 which comprises the critical component of the present invention as is hereinafter discussed. Apparatus 10 also comprises exhaust ports 24 and an exhaust valve 26 which in combination provide means for exhausting the exhalation gas of the user through the regulator 10.

Diaphragm 16 in effect establishes two isolated chambers within the housing 14 of the regulator, namely, interior chamber 21 and exterior chamber 23. The position of diaphragm 16 is determined by the relative pressure differential between the chambers 21 and 23 as well as the effect on the diaphragm of the force applied by a spring (not shown). Spring 15 is a purge spring not directly related to the novel features of the present invention. The center of the diaphragm is provided with a bearing surface 25 which bears against the lever 17 the position of which determines whether the air inlet valve 18 is opened or closed.

The interaction of the diaphragm 16 and the two chambers 21 and 23 creates a dynamic air motion effect which may be termed venturi initiated vacuum assist. More specifically, when the user begins to inhale through the mouthpiece 20 the air pressure in interior chamber 21 is reduced. This reduction in the air pressure within chamber 21 causes the central portion of diaphragm 16 to be sucked in towards chamber 21 compressing lever 17 and opening the air inlet valve 18. When the air inlet valve is opened, a stream of air is generated in the general direction of the mouthpiece 20 through the mouthpiece tube 19 thereby responding to the user's inhalation requirements, but also creating a venturi effect generated by the high velocity air emanating from the air inlet valve 18. This high velocity air pulls the still air inside the regulator along with it, causing a secondary pressure drop or a vacuum to exist inside the interior chamber 21.

The initial inhalation effort required to open the air inlet valve 18 is commonly referred to as the cracking effort. The extent of inhalation effort required after the cracking effort level has been reached depends on the extent to which the level of venturi assist is utilized during the remainder of the breathing cycle. In those prior art regulator devices in which virtually no further breathing effort is required, the user may incur a disadvantageous condition in which the air inlet valve remains open due to the venturi effect thus creating a condition of free flow which in effect forces air into the user's lungs. Such a condition may be desirable for the experienced diver under certain deep dive or other difficult breathing conditions. However, the less experienced diver may find such a free flow condition to be frightening or otherwise disadvantageous. For example, such free flow conditions occurring when the regulator is out of the mouth of the user can create a panicky environment for the diver who feels great concern over the loss of air from his tanks.

In any case, as previously noted, the relevant prior art has already disclosed means for changing the venturi assist effect whereby to overcome the noted disadvantages of those regulators which have employed full venturi assist configurations. The present invention however provides a novel means for varying the venturi assist and this novel means may be best understood by reference to FIGS. 2 and 3. More specifically, FIGS.

Figure 3:
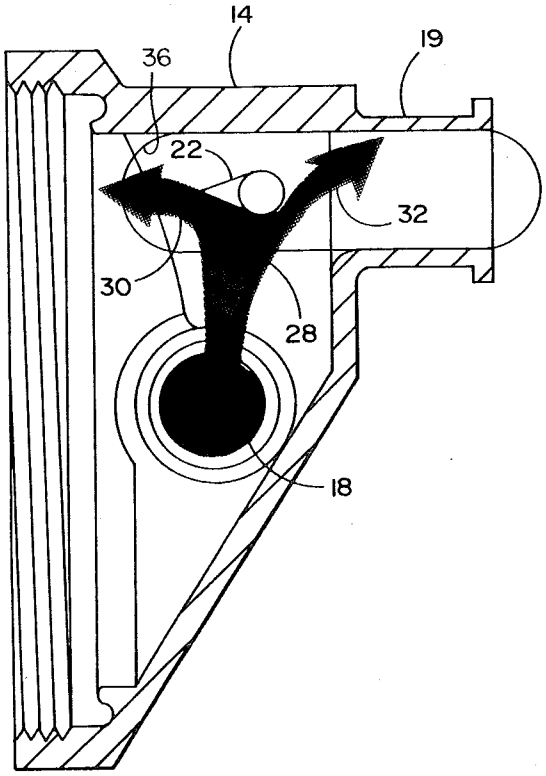
FIGS. 2 and 3 are similar cross-sectional views of a portion of the invention illustrating the manner in which the novel flow vane thereof affects air flow in the invention.

2 and 3 illustrate two different adjustment configurations of the flow vein 22 of the present invention and the relative effects of such flow vane positions on the air stream emanating from the air inlet valve after the inhalation effort of the user has surpassed the cracking effort level. The configuration of the invention shown in FIG. 2 corresponds to a flow vane adjustment position wherein all or virtually all of the air stream 28 emanating from the air inlet valve 18 is directed into the mouthpiece tube 19. On the other hand, the condition of the regulator as illustrated in FIG. 3 is such that the flow vane 22 is positioned to have an entirely different effect on the air stream 28. More specifically, as seen in FIG. 3, the position of flow vein 22 has the effect of splitting the air stream 28 into two components, namely, a first component 30 which is directed towards the diaphragm 16 and a second component 32 which is directed through the mouthpiece tube 19. Those having skill in the art to which the present invention pertains will appreciate that the backflow stream 30 which is directed toward the diaphragm 16 will counter the venturi effect of the forward flow stream 32. The extent to which this venturi countering effect takes place depends upon the respective flow volume of streams 30 and 32 which in turn depends upon the position of flow vane 32. Thus, it will be seen that the position of flow vane 22 in the present invention can substantially alter the degree to which the breather's inhalation effort is assisted by the venturi effect generated by the air flow out of the air inlet valve 18.

Figure 2:
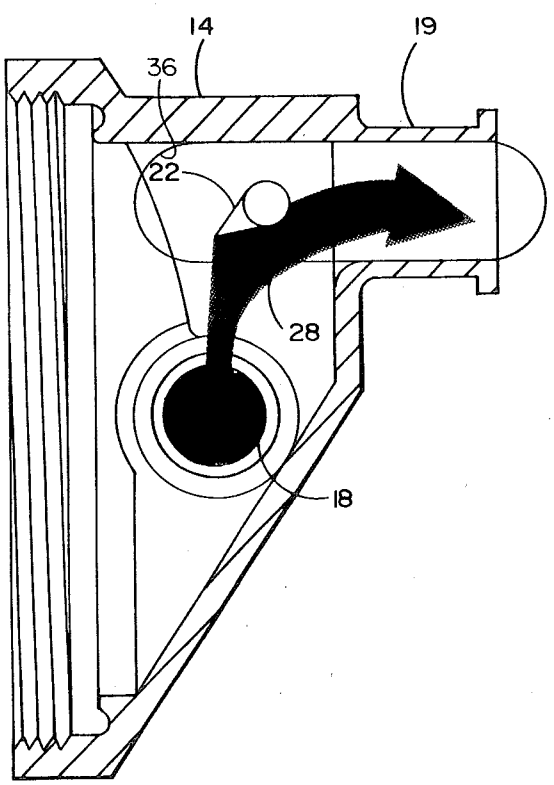
Figure 5:
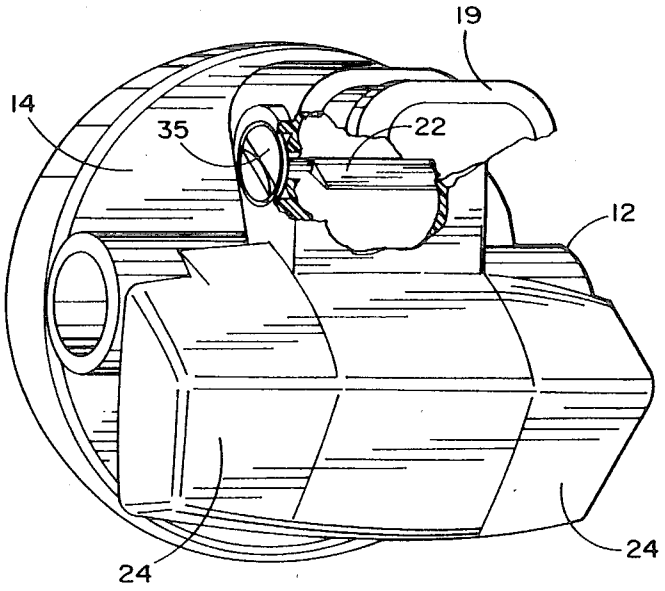
FIG. 5 is a three-dimensional view similar to that of FIG. 4 but illustrating the invention with a portion of the mouthpiece tube thereof broken away to better show the flow vane thereof.
Figure 4:
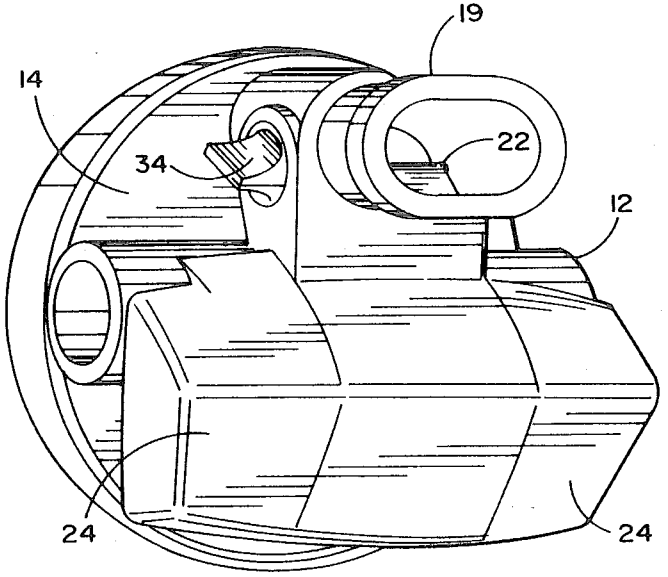
FIG. 4 is a three-dimensional view of the regulator of the invention.

Alternative structural implementations of the present invention are illustrated in FIGS. 4 and 5 wherein it is seen that the flow vane 22 is provided in the mouthpiece tube 19. In the configuration of FIG. 4 flow vane 22 is connected to a flow vane knob 34 which is provided with a readily accessible surface to permit the diver to vary the position of the flow vane while using the breathing regulator of the present invention. In FIG. 5 wherein a portion of mouthpiece tube 19 has been cut away in order to provide a better view of flow vane 22, it is seen that the flow vane is connected to an alternative means for controlling its position, namely, a screw knob 35 having a slotted head to permit variation of the position of the flow vane 22 in a different manner such as with a screwdriver or coin if for some reason it is neither desirable nor convenient to provide the knob configuration of FIG. 4. In either case, it is seen in FIGS. 4 and 5 that the flow vane 22 is preferably positioned within the mouthpiece tube 19 at about the center thereof and transverse to the direction of air flow into the diver's mouth whereby to influence the distribution of the air stream as previously discussed in conjunction with FIGS. 2 and 3. Of course, it may be desirable to utilize flow vane configurations which are larger or smaller than that shown in FIGS. 4 and 5 or for that matter, of a different shape as long as the basic air stream effects are as described in conjunction with FIGS. 2 and 3 are generated.

Figure 6:
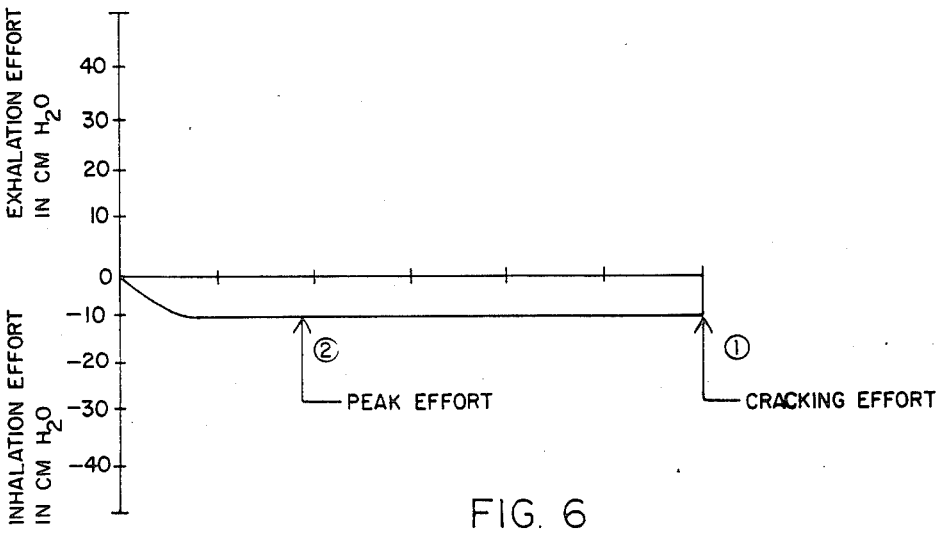
FIGS. 6–8 are graphical representations of the inhalation breathing performance of the present invention at three different settings of the flow vane thereof.
Figure 7:
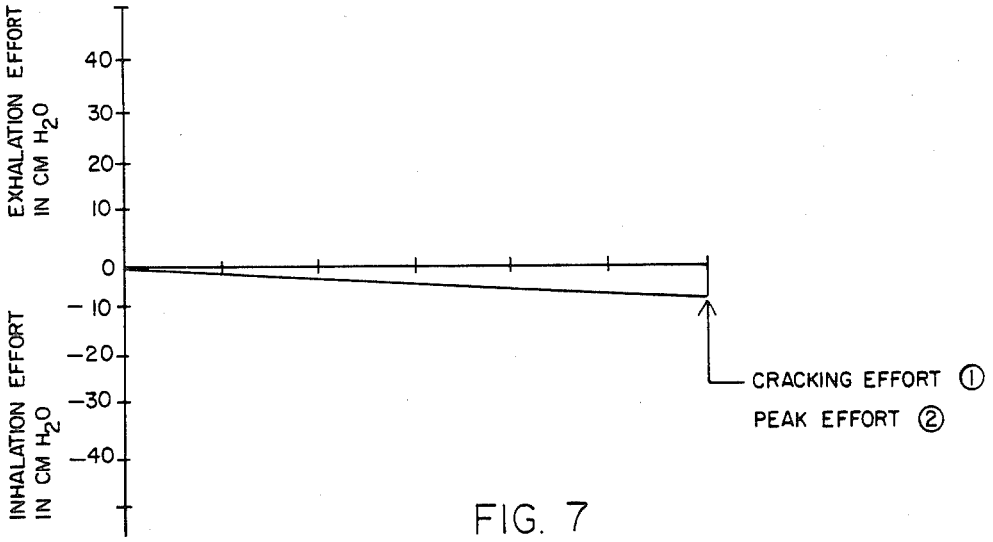
Figure 8:
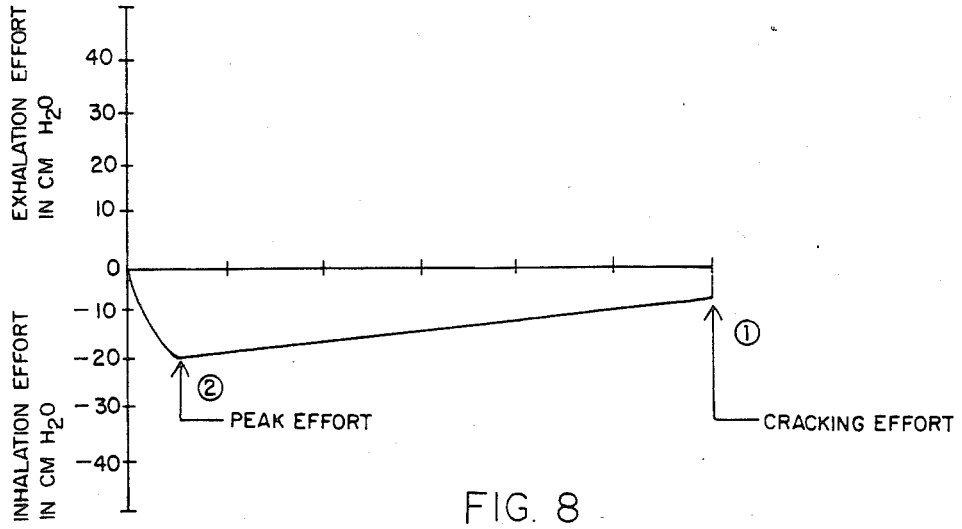

The inhalation performance of the present invention may be observed graphically for three different settings of the position of flow vane 22 as represented by FIGS. 6, 7 and 8, respectively. Furthermore, the performance of the present invention as compared to the closest known prior art may be more fully appreciated by comparing the graphs of FIGS. 6, 7 and 8 with the graphs of FIGS. 9–12, respectively, the latter figures of which represent the performance of such prior art. In each instance of FIGS. 6–12 the vertical axis represents the breathing resistance and the horizontal axis represents the tidal volume. In all cases only the inhalation effort portion of the breathing cycle is shown since that is the only part thats relevant to the present invention and each of the graphs were generated with identical parameters insofar as tidal volume, equivalent breathing rate and diver depth.

FIG. 6 represents the inhalation effort during the breathing cycle using the present invention and having the flow vane 22 of the invention adjacent to provide a virtually constant breathing effort throughout almost the entire breathing cycle. As indicated in FIG. 6, the cracking effort which is the effort required by the diver to initially start flow upon inspiration and designated by the number 1 in FIG. 6 is the same as the peak effort during the entire breathing cycle designated by the number 2 in FIG. 6. FIG. 7 represents the inhalation work effort wherein the flow vane 22 is adjusted to maximize the venturi effect, that is, to force the air stream through the mouthpiece tube 19 with little or no portion of the air stream being deflected towards the diaphragm. It will be observed in FIG. 7 that in this fully assisted configuration, the cracking effort is in fact the peak effort throughout the breathing cycle with the inhalation effort diminishing linearly during the remainder of the breathing cycle after the cracking effort has been achieved.

The graph of FIG. 8 represents a flow vein configuration in which to a maximum extent, the air stream out of the inlet valve is deflected towards the diaphragm thereby virtually defecting the venturi action for assisting the diver during the breathing cycle. In this configuration it is seen that the inhalation effort after the cracking effort increases linearly towards the end of the inhalation cycle and reaches a peak effort of about twice the cracking effort just prior to the end of the inhalation portion of the breathing cycle. It will of course be understood that the graph of inhalation effort of FIG. 6 corresponds to a flow vane adjustment condition that is between the flow vane settings of FIGS. 7 and 8. However, in all of the three cases represented by FIGS. 6, 7 and 8 it is to be observed that the performance of the breathing regulator of the present invention as represented by the inhalation effort of the diver is either constant or substantially linear without any sudden changes which as it will be seen hereinafter is a disadvantageous parameter of the prior art. It is believed that the relatively low inhalation effort of the present invention is represented in all three figures combined with the ability to provide a performance characteristic which is relatively linear and in fact adjustable to be flat as shown in FIG. 6 is an important novel feature of the present invention not available in the prior art.

Figure 9:
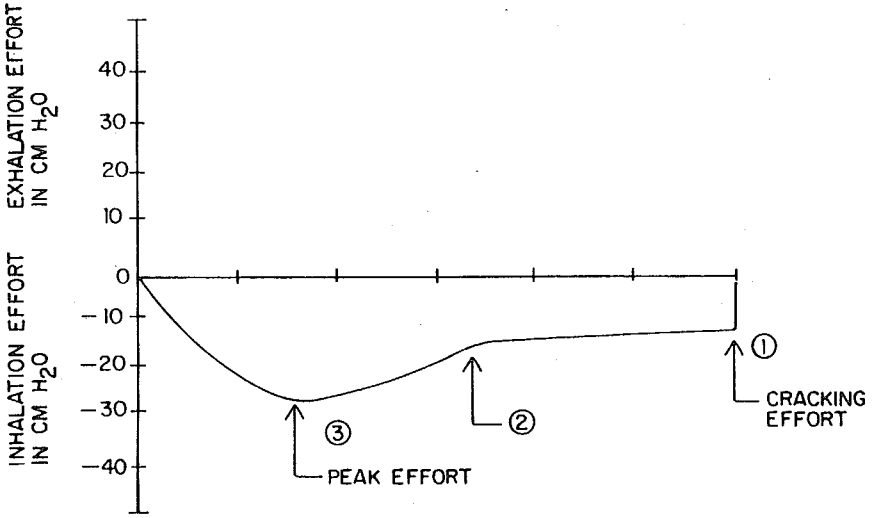
FIGS. 9–12 are graphical representations similar to those of FIGS. 6–8 but illustrating the comparable performance of the closest known prior art.
Figure 10:
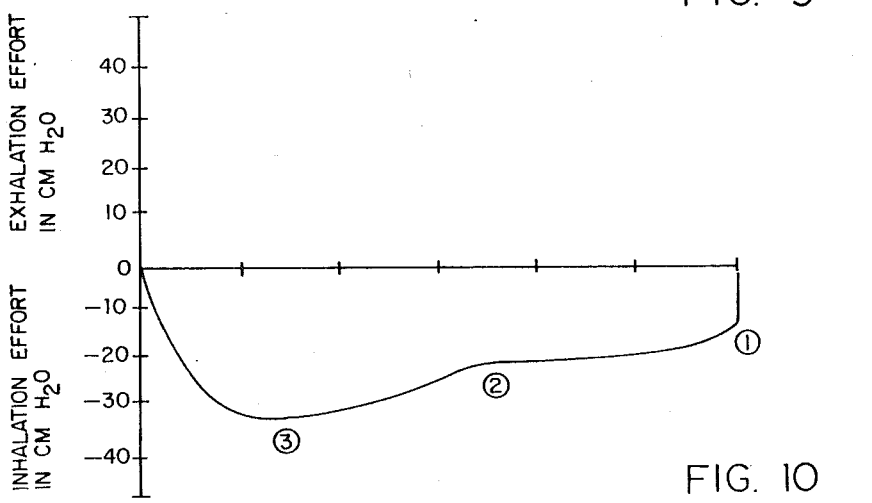

For purposes of comparing the present inventions performance to the closest prior art, FIGS. 9–12 illustrate the inhalation breathing effort of the device disclosed in U.S. Pat. No. 4,147,176 to Christianson at various adjustment settings of that prior art apparatus. More specifically, the graph of FIG. 9 represents what appears to be the flattest possible curve achievable with that prior art device. Because of its non-linear character, three points are used to identify the features of the performance characteristic of the Christianson device in FIGS. 9–12. Thus for example, in FIG. 9 reference numeral 1 represents the cracking effort which is greater than the corresponding cracking of the applicant's invention. Reference numeral 3 represents the peak effort required of the diver during the inhalation portion of the breathing cycle using the Christianson device adjusted for the flattest possible curve and reference numeral 2 represents the point in the performance of the Christianson apparatus which because of the interaction between the diaphragm and the conical space upon which the diaphragm resides, the effective diaphragm area is made smaller and the breathing effort at this point begins to increase non-linearly relative to the earlier portion of the inhalation breathing cycle. FIG. 10 is a representation of the inhalation breathing effort using the Christianson apparatus set to provide a minimum of venturi assistance. It will be seen in FIG. 10 that this curve shape is similar to that of FIG. 9 but with all the inhalation effort points beyond the cracking effort being greater than that of FIG. 9.

Figure 11:
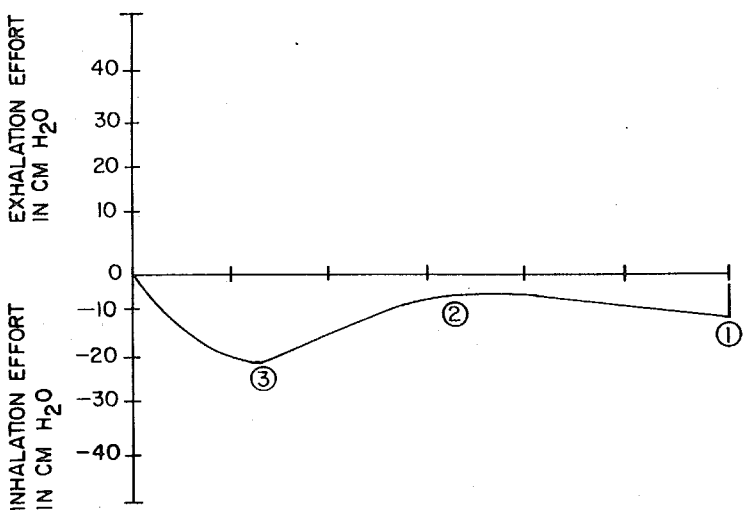
Figure 12:
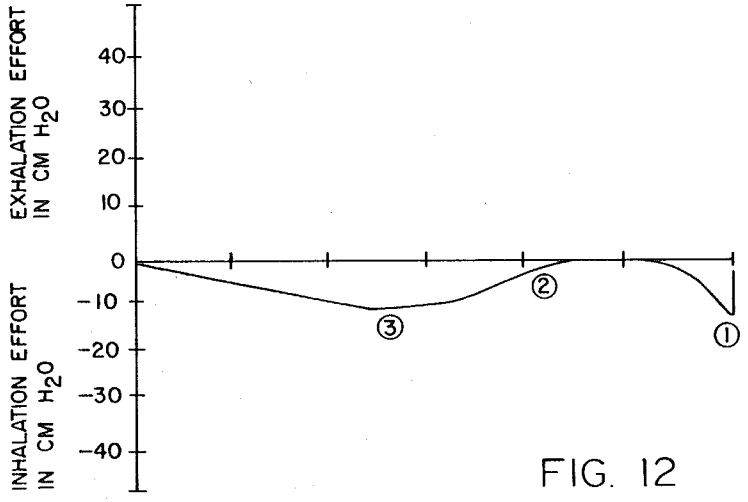

The graph of FIG. 11 represents an intermediate level of venturi assistance derived using the Christianson device and the graph of FIG. 12 represents the inhalation breathing requirements of the same device where the venturi action is maximized. In both cases it can be seen that the inhalation effort of the prior art Christianson device is substantially non-linear and non-uniform throughout the breathing cycle. This of course is due to the change in the effective area of the diaphragm during the breathing cycle in the Christianson device and as indicated, leads to a significant degree of performance variation during the breathing cycle as compared to the significantly linear and even flat characteristics of the present invention.

It will now be understood that what has been disclosed herein comprises a breathing regulator in which an externally adjustable flow deflector to flow vane is utilized in creating a disturbance or diversion of high velocity air directed at the mouthpiece area of the regulator housing whereby to provide an adjustable means for balancing the vacuum assist in demand regulators. The deflecting flow vane interrupts a selectible portion of the air stream and redirects it back into the housing thus balancing the low pressure area behind the diaphragm which prevents a free flow condition and allows the demand regulator to be less sensitive to ambient water conditions. The vane can readily varied by the diver external of the regulator from one extreme in which the air stream is virtually free flowing into the mouthpiece to another extreme in which all or virtually all of the air stream is interrupted and deflected towards the diaphragm to substantially defeat the assist effect of the venturi action. As a result, the present invention comprises a breathing regulator in the form of a venturi assist and demand regulator which is less complex in structure and more predictable in performance as compared to the prior art and which has an assist level which either remains constant or varies linearly throughout the breathing cycle for a selected setting of the flow vane relative to the air flow. The present invention is unique in that the venturi assist level can be selectively varied external of the breathing regulator and can be adjusted to remain constant during the entire breathing cycle.

Those having skill in the art to which the present invention pertains will of course as a result of the applicant's teaching herein now perceive various modifications and additions to the invention. By way of example, the precise structural configuration and location of the flow vane of the present invention may be varied while still accomplishing the linear or constant flow characteristics derived from the flow vane concept of the present invention. Accordingly, all such modifications and additions are deemed to be within the scope of the invention which is to be limited only by the claims appended hereto.

I claim:

1. An improved breathing regulator apparatus for use by a scuba diver having a housing; a movable diaphragm extending across one end of said housing to define a breathing chamber; a mouthpiece tube fluidly coupled to said breathing chamber extending from the opposing end of said housing and integrally formed therein; an air inlet fluidically coupled to said breathing chamber and adapted for connection to a pressurized source of air; an air inlet valve means for controlling the air stream from the pressurized source to said mouthpiece tube; and means connecting said valve means to said diaphragm for operating said valve means responsive to a reduction in pressure within the regulator induced by inhalation of air through said mouthpiece tube by the scuba diver during an inhalation portion of a breathing cycle, the improvement comprising:

flow vane means pivotedly mounted within said mouthpiece tube adjacent said breathing chamber having a first positional location for intercepting and directing the air stream through said mouthpiece tube; said flow vane means creating a venturi effect to assist in the reduction in pressure within said regulator induced by the inhalation, said flow vane means having a second positional location for redirecting at least a predetermined portion of the air stream toward said diaphragm thereby reducing the venturi effect, and means for manually varying the orientation of said flow vane means between said first and second positional locations to adjust the portion of the air stream being redirected; said means for manually varying said positional location of said flow vane means extending through said mouthpiece tube external of said housing for permitting the scuba diver to adjust said flow vane means during operation of said breathing regulator apparatus.

2. The improvement recited in claim 1 wherein said means for manually varying the orientation of said flow vane means comprises an adjustment knob connected to said flow vane means and extending through said mouthpiece tube to the exterior thereof, wherein said knob is externally accessible to the scuba diver.

3. The improvement recited in claim 1 wherein said means for manually varying the orientation of said flow vane means provides adjustable deflection of the air stream wherein inhalation effort for maintaining the air stream remains constant throughout substantially the entire inhalation portion of the breathing cycle.

4. An improved breathing regulator apparatus for use by a scuba diver having a housing; a movable diaphragm extending across one end of said housing to define a breathing chamber; a mouthpiece tube fluidly coupled to said breathing chamber extending from the opposing end of said housing and integrally formed therein; an air inlet fluidically coupled to said breathing chamber and adapted for connection to a pressurized source of air; an air inlet valve means for controlling the air stream from the pressurized source to said mouthpiece tube; and means connecting said valve means to said diaphragm for operating said valve means responsive to a reduction in pressure within the regulator induced by inhalation of air through said mouthpiece tube by the scuba diver during an inhalation portion of a breathing cycle, the improvement comprising:

a deflecting means pivotedly mounted within said mouthpiece tube adjacent said breathing chamber having a first positional location for intercepting and directing the air stream through said mouthpiece tube; said deflecting means creating a venturi effect to assist in the reduction in pressure within said regulator induced by the inhalation, said deflecting means having a second positional location for redirecting at least a predetermined portion of the air stream toward said diaphragm thereby reducing the venturi effect, and means for manually varying the orientation of said deflecting means between said first and second positional locations to adjust the portion of the air stream being redirected; said means for manually varying said positional location of said deflecting means extending through said mouthpiece tube external of said housing for permitting the scuba diver to adjust said deflecting means during operation of said breathing regulator apparatus.

5. The improvement recited in claim 4 wherein said means for manually varying the orientation of said deflecting means comprises an adjustment knob connected to said deflecting means and extending through said mouthpiece tube to the exterior thereof, wherein said knob is externally accessible to the scuba diver.

6. The improvement recited in claim 4 wherein said means for manually varying the orientation of said deflecting means provides adjustable deflection of the air stream wherein inhalation effort for maintaining the air stream remains constant throughout substantially the entire inhalation portion of the breathing cycle.

* * * * *